US005455137A

United States Patent [19]

Diaz et al.

[11] Patent Number: 5,455,137

[45] Date of Patent: Oct. 3, 1995

[54] TONER COMPOSITION

[75] Inventors: Arthur F. Diaz, San Jose; Adolfo R. Guitierrez, Gilroy, both of Calif.

[73] Assignee: International Business Machines Corporation, Armonk, N.Y.

[21] Appl. No.: 171,596

[22] Filed: Dec. 21, 1993

[51] Int. Cl.[6] ..... G03G 9/08

[52] U.S. Cl. ..... 430/110; 430/107

[58] Field of Search ..... 430/110, 903, 430/107

[56] References Cited

U.S. PATENT DOCUMENTS

| | | | |
|---|---|---|---|
| 4,029,513 | 6/1977 | Vessey et al. | 106/288 B |
| 4,321,243 | 3/1982 | Cornwell et al. | 423/267 |
| 4,640,882 | 2/1987 | Mitsuhashi et al. | 430/110 |
| 4,845,004 | 7/1989 | Kobayashi | 430/110 |
| 4,868,084 | 9/1989 | Uchide et al. | 430/110 |
| 4,902,570 | 2/1990 | Heinemann et al. | 428/405 |
| 4,902,598 | 2/1990 | Winnik et al. | 430/111 |
| 5,024,915 | 6/1991 | Sato et al. | 430/110 |
| 5,176,979 | 1/1993 | Eguchi et al. | 430/110 |
| 5,178,984 | 1/1993 | Nagatsuka et al. | 430/110 |
| 5,202,209 | 4/1993 | Winnik et al. | 430/110 |

FOREIGN PATENT DOCUMENTS

| | | | |
|---|---|---|---|
| 3320968 | 12/1984 | Germany . | |
| 62-52561 | 3/1987 | Japan | 430/110 |
| 1-237561 | 9/1989 | Japan | 430/110 |

OTHER PUBLICATIONS

Patents & Trademark Office English Translation of Japanese Patent 62–52561 (Pub. Mar. 7, 1987).

English–Language Abstract of Japanese Patent J01237561 A (Pub. Sep. 22, 1989).

*Primary Examiner*—Janis L. Dote

*Attorney, Agent, or Firm*—Robert B. Martin

[57] ABSTRACT

The present invention relates to an improved toner composition comprising an improved particulate silica dispersing agent. The improved particulate silica is non-charging base treated fumed silica which has been treated with a base having a pH of 10 or greater.

12 Claims, No Drawings

TONER COMPOSITION

FIELD OF THE INVENTION

The present invention relates to an improved toner composition for use in electrophotography comprising an improved dispersing agent.

BACKGROUND OF THE INVENTION

In electrophotography an image comprising an electrostatic field pattern, usually of non-uniform strength, (also referred to as an electrostatic latent image) is formed on an insulative surface of an electrophotographic element. The insulative surface comprises a photoconductive layer and an electrically conductive substrate. The electrostatic latent image may be formed by imagewise photo-induced dissipation of the strength of portions of an electrostatic field of uniform strength previously formed on the insulative surface. Typically, the electrostatic latent image is then developed into a toner image by contacting the latent image with a toner composition generally containing a pigment. The toner image is then transferred onto a transfer medium such as paper and fixed thereon by heating and/or pressure. The last step involves cleaning residual toner from the electrophotographic element.

Dry toner compositions used in electrophotography are divided into one-component compositions composed of a toner generally comprising a binder resin having a colorant dispersed therein and two-component compositions composed of a toner and a carrier. Charge control agents are often melt mixed with the toner resin to control the chargeability of the toner during use. In order that toner compositions have process suitability in copying, they are required to be excellent in fluidity, anti-caking properties, fixability, chargeability, cleaning properties, etc. To improve these properties, particularly fluidity and anti-caking properties, extraparticulate inorganic fine particles are frequently added to toner compositions.

Dispersibility of the inorganic fine particles has a great influence on toner composition characteristics. Particles of poor dispersibility tend to fail to obtain desired effects of improving fluidity and anti-caking properties or tend to cause adhesion of toner particles to a photoreceptor due to insufficient cleaning, resulting in image defects such as black spots.

Particulate silica such as funded silica is used to provide good dispersibility, fluidity and anticaking properties in toner compositions. Unfortunately, fumed silica has a strong negative charge which seriously reduces the chargeability of positively chargeable toner compositions. Because the silica also effects the charge of negatively chargeable toners, it complicates the design and use of negatively chargeable toner compositions. The strong negative charge of fumed silica negatively impacts the reproducibility of both positively and negatively chargeable toner compositions by exhibiting great variations of chargeability with environmental changes between summer and winter, often resulting in background fog and insufficient density reproduction.

In an effort to overcome these problems, silica particles have been surface treated with various compounds such as aminosilanes, polyacrylates and quaternary ammonium salts to form positively chargeable silica particles. However, these particles are still charging and also are generally colored which prevents there use in certain applications. Therefore, there still is a need in the art for a suitable silica particle for use in toner compositions.

It is therefore an object of the present invention to provide an improved toner composition comprising improved silica particles.

Other objects and advantages will become apparent from the following disclosure.

SUMMARY OF THE INVENTION

The present invention relates to an improved particulate toner composition for use in electrophotography comprising toner and base treated silica. Optionally, the composition may also comprise a colorant, a carrier, a charge control agent and other additives known to those skilled in the art. Surprisingly, the base treated silica does not charge nor does it contribute to the charge of the toner composition during use in the development process in electrophotography.

A more thorough disclosure of the present invention is presented in the detail description which follows.

DETAILED DESCRIPTION OF THE INVENTION

The present invention relates to an improved particulate, dry toner composition for use in electrophotography comprising toner and base treated silica. The key ingredient in the composition of the present invention is the based treated silica. As used herein "base treated silica" shall mean silica particles which have been contacted with a strong base. Fumed silica is preferred in the toner composition of the present invention. Other types of suitable particulate silica will be known to those skilled in the art. The particles are colorless and preferably fine having a particle size diameter of about 1 to 100 nanometers (nm) preferably about 5 to 50 nm more preferably about 7 to 20 nm. The strong base used to treat the silica particles suitably has a concentration of about 1.0 to about 0.001 molar, preferably about 0.1 to about 0.01 molar. The strong base will preferably have a high dissociation constant and preferably the base will be completely dissociated. The strong base will have pH of about 10 or greater, preferably greater than about 10.5, more preferably greater than about 11, more preferably greater than about 11.5 and most preferably greater than about 12. Very high pH may cause some dissolution of the silica. Preferably the base is a Bronsted base, preferably an alkali or alkaline base. The preferred base anion is hydroxide. Ammonium hydroxide is not particularly suitable for use in the present invention.

The silica particles are suitably contacted with a liquid base (base dissolved in a suitable solvent, preferably methanol or aqueous methanol) for a short period of time of about 10–60 minutes with stirring. It is preferred that the pH remain constant (±1) during the reaction. The silica particles are then removed from the liquid base by filtration or centrifugation, rinsed several times with suitable solvent such as methanol to remove base and dried in a vacuum oven at an elevated temperature e.g. 50° C. Optionally, to improve the flow properties of the base-treated silica, it can be rinsed with a dilute acid (such as hydrochloric or sulfuric acid) after treatment with base to remove any remaining base. The dilute acid wash does not effect the non charging property of the base treated silica.

A variety of toner particles known to those skilled in the art can be used in the toner composition of the present invention. Toner particles generally comprise a resin and optionally a colorant.

As a resin for the toner particles to be used in the present invention, there may be employed homopolymers of styrene and its derivatives and copolymers thereof such as polystyrene, poly-p-chorostyrene, polyvinyltoluene, styrene-p-chlorostyrene copolymer, styrene-vinyltoluene copolymer; copolymers of styrene and acrylic acid ester such as styrene-methyl acrylate copolymer, styrene-ethyl acrylate copolymer, styrene-n-butyl acrylate copolymer, styrene-2-ethylhexyl acrylate copolymer; copolymers of styrene and methacrylic acid ester such as styrene-methyl methacrylate, styrene-ethyl methacrylate, styrene-n-butyl methacrylate, styrene-2-ethylhexyl methacrylate; multi-component copolymers of styrene, acrylic acid ester and methacrylic acid ester; styrene copolymers of styrene with other vinyl monomers such as styrene-acrylonitrile copolymer, styrene-vinyl methyl ether copolymer, styrene-butadiene copolymer, styrene-vinyl methyl ketone copolymer, styrene-acrylonitrile-indene copolymer, styrene-maleic acid ester copolymer; polymethyl methacrylate, polybutyl methacrylate, polyvinyl acetate, polyester, epoxy resin, polyvinyl butyral, polyacrylic acid resin, phenolic resin, aliphatic or alicyclic hydrocarbon resin, petroleum resin, chlorine paraffin, either individually or as a mixture.

Suitable resins for the toner particles for use with pressure fixing electrophotography, are low molecular weight polyethylene, low molecular weight polypropylene, ethylene-vinyl acetate copolymer, ethylene-acrylic acid ester copolymer, higher fatty acid and polyester resin. Other types of suitable resins for toner particles in the composition of the present invention will be known to those skilled in the art.

Optional colorants for the toner particles include a pigment or a dye as the colorant. For example, carbon black, solvent black, phthalocyanine blue, Ultramarine, quinacridone, benzidine yellow may be utilized.

The resin and colorant components of the toner can be admixed in any convenient manner such as by melt-blending a mixture of the components in a mixer such as Rheomix twin screw mixer. The solidified melt is ground to desired size (size classified) to form a free-flowing powder of toner particles. Alternatively, the toner components can be solution blended in a volatile solvent such as dichloromethane and then atomized in a spray dryer to produce toner particles, as is well known.

Toner particles may have an average diameter between about 0.5 microns (μm) and about 50 μm, a value in the range from about 8.0 to about 20 μm being preferable for many currently used machines. However, larger or smaller particles may be needed for particular methods of development or development conditions.

The toner composition of the present invention will generally comprise about 99.99 to about 90 weight % of the toner and about 0.01 to about 10 weight % of the base-treated silica preferably about 0.02 to 5 weight % base-treated of silica.

If desired, the loner particles of the present invention may further comprise known additives such as a charge control agent. Specific examples of the charge control agent include positive charge control agents, e.g., nigrosine dyes, quaternary ammonium salts, pyridinium salts, and phosphonium salts or negative charge control agents such as organic sulfates, phosphates or carboxylates.

The toner particles of the invention may be used alone in monocomponent developers or may be mixed with a suitable carrier vehicle known to those skilled in the art for use in dual component developers. The carrier vehicles which can be used to form developer compositions can be selected from various materials. Such materials include carrier core particles and core particles overcoated with a thin layer of film-forming resin to establish the correct triboelectric relationship and charge level with the toner employed. Suitable carriers for two component toner compositions include iron powder, glass beads, crystals of inorganic salts, ferrite powder, nickel powder an these powders having thereon a resin coating such as epoxy or fluorocarbon resins.

The toner composition of the present invention may also contain other known additives such as waxes and siloxane oils. The toner composition is conveniently made by mixing the toner particles with the extraparticulate base-washed silica together in a blender.

The following examples are detailed descriptions of compositions of the present invention. The descriptions fall within the scope of, and serve to exemplify, the more generally described compositions set forth above. The examples are presented for illustrative purposes only, and are not intended as a restriction on the scope of the invention.

CHARGING EXPERIMENTS

I. Components

1. Toner-poly(styrene-co-butylmethacrylate).
2. Silica-(fumed, hydrophobic, methylated) particle size 7 nm.
3. Base-treated silica is the fumed silica which has been contacted with 0.1 molar KOH (pH=13) for period of 2 hours and then vacuumed dried and recrushed
4. Toner Composition is dual component comprising 97.5 weight % of steel carrier beads (140 micron) and 2.5 weight % of toner comprising (99.8 wt. %) poly(styrene-co-butylmethacrylate) and silica (0.2 wt. %).

II. Test Procedure

The toner composition was rolled in a metal can for 10 minutes. Aliquots of the composition were then transferred to a Faraday cage, known as a blow-off cage, and the toner was blown away from the carrier and out of the cage using forced air. The charge on the toner was obtained from the charge (Q) an weight (M) change of the cage and was reported as Q/M.

III. Results

| Component(s) in Toner Composition | Q/M (uC/g)* |
|---|---|
| Toner | −5 |
| Toner/silica | −16 |
| Toner/base treated silica | −3 |

The results of the test surprisingly show that the base-treated silica does not negatively charge the toner composition. The base treated silica particles provide good fluidity and anticaking properties to the toner composition.

Although this invention has been described with respect to specific embodiments, the details thereof are not to be construed as limitations for it will be apparent that various embodiments, changes, and modifications may be resorted to without departing from the spirit and scope thereof, and it is understood that such equivalent embodiments are intended to be included within the scope of this invention.

We claim:

1. A dry particulate toner composition for use in electrophotography comprising toner and noncharging base treated fumed silica which has been treated with a base having a pH of 10 or greater.

2. The composition of claim 1 further comprising a charge control agent.

3. The composition of claim 2 further comprising a carrier.

4. The composition of claim 2 wherein said charge control agent has a positive charge.

5. The composition of claim 2 wherein said charge control agent has a negative charge.

6. The composition of claim 2 wherein said toner comprises poly(styrene-co-methacrylate).

7. The composition of claim 2 wherein said toner comprises poly(styrene-co-acrylate).

8. The composition of claim 2 wherein said toner contains a colorant.

9. A particulate, dry toner composition for use in electrophotography comprising toner, charge control agent, colorant and a non-changing base treated fumed silica which has been treated with a base having a pH of 10 or greater.

10. The composition of claim 9 further comprising a carrier.

11. The composition of claim 9 wherein said toner comprises poly(styrene-co-methacrylate).

12. The composition of claim 9 wherein said toner comprises poly(styrene-co-acrylate).

* * * * *